US010522896B2

(12) United States Patent
Weale

(10) Patent No.: US 10,522,896 B2
(45) Date of Patent: Dec. 31, 2019

(54) EMBEDDED DIRECTIONAL COUPLERS AND RELATED METHODS

(71) Applicant: SEMICONDUCTOR COMPONENTS INDUSTRIES, LLC, Phoenix, AZ (US)

(72) Inventor: Gareth Pryce Weale, New Hamburg (CA)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 60 days.

(21) Appl. No.: 15/270,314

(22) Filed: Sep. 20, 2016

(65) Prior Publication Data

US 2018/0083336 A1 Mar. 22, 2018

(51) Int. Cl.
*H01P 5/18* (2006.01)

(52) U.S. Cl.
CPC ..... *H01P 5/187* (2013.01)

(58) Field of Classification Search
CPC ..... H01P 5/18; H01P 5/185
USPC ..... 333/109–112, 116, 117
See application file for complete search history.

(56) References Cited

U.S. PATENT DOCUMENTS 3,315,182 A * 4/1967 Woolley, Jr. ..... H01P 5/183 333/115
4,139,827 A * 2/1979 Russell ..... H01P 5/187 333/116
4,677,399 A * 6/1987 Le Dain ..... H01P 5/185 333/116
4,914,407 A * 4/1990 Itoh ..... G02F 1/025 331/107 SL
5,373,266 A 12/1994 Lenzing et al.
(Continued)

FOREIGN PATENT DOCUMENTS

JP 2014165823 A * 9/2014

OTHER PUBLICATIONS

Abdullah Eroglu and Jay Kyoon Lee, "The Complete Design of Microstrip Directional Couplers Using the Synthesis Technique," 57 IEEE Transactions on Instrumentation and Measurement No. 12, Dec. 2008, p. 2756-2761.
(Continued)

*Primary Examiner* — Dean O Takaoka
(74) *Attorney, Agent, or Firm* — Adam R. Stephenson, Ltd.

(57) ABSTRACT

A directional coupler includes an electrically conductive main line coupled at least partially in and/or on a dielectric layer and having input and output ports. An electrically conductive coupled line separated from the main line includes a coupled port and is at least partially formed in and/or on the dielectric layer. An electrically conductive ground layer couples with the dielectric layer and is electrically isolated from the main and coupled lines. One or more tuning elements, formed of electrically conductive elements arranged in a pattern (but electrically isolated from the main and coupled lines and ground layer) and/or formed using an electrically conductive layer (the electrically conductive layer electrically isolated from the main and coupled lines and ground layer and with or without a pattern of openings therein) are at least partially encapsulated in the dielectric layer and increase a coupling coefficient and/or directivity of the directional coupler.

10 Claims, 10 Drawing Sheets

(56) References Cited

U.S. PATENT DOCUMENTS

| | | | | |
|---|---|---|---|---|
| 5,424,694 | A | 6/1995 | Maloratsky et al. | |
| 5,487,184 | A * | 1/1996 | Nagode | H01P 5/187 333/116 |
| 5,576,669 | A | 11/1996 | Ruelke | |
| 5,767,753 | A * | 6/1998 | Ruelke | H01P 5/18 333/116 |
| 6,323,741 | B1 * | 11/2001 | Kim | H01P 5/185 333/116 |
| 6,549,089 | B2 | 4/2003 | Ashoka | |
| 7,088,201 | B2 * | 8/2006 | Piernas | H01P 5/187 333/116 |
| 7,741,929 | B2 * | 6/2010 | Hash | H01P 5/185 333/116 |
| 8,314,664 | B2 * | 11/2012 | Bertram | H01P 5/184 333/109 |
| 8,384,493 | B2 * | 2/2013 | Sertel | H01P 1/184 333/109 |
| 9,088,061 | B2 | 7/2015 | Balijapalli et al. | |
| 2014/0292440 | A1 * | 10/2014 | Hirota | H01P 5/187 333/116 |
| 2014/0361953 | A1 | 12/2014 | Spokoinyi | |

OTHER PUBLICATIONS

G. Sunny Kumar, K. Soujanya, and V. Revathi, "Design and Development of Stripline Dual Directional Coupler for Monitoring Forward Power and Reflected Power," 2 International Journal of Electronics & Communication Technology (IJECT) issue 4, Oct.-Dec. 2011, p. 152-156.

Robert C. Frye, Robert Melville, Guru Badakere, Yaojian Lin, and Kai Liu, "Theory of Compact Narrow-Band Directional Couplers and Implementation in Silicon IPD Technology," IEEE, proceedings of International Microwave Symposium (IMS) 2009 in Boston, p. 993-996.

B. Jaskorzynska, Z.J. Zawistowski, M. Dainese, J. Cardin, L. Thylen, "Widely Tunable Directional Coupler Filters with 1D Photonic Crystal," Proceedings of the 2005 7th International Conference of Transparent Optical Network, Jul. 7, 2005, Institute of Electrical and Electronics Engineers.

* cited by examiner

EMBEDDED DIRECTIONAL COUPLERS AND RELATED METHODS

BACKGROUND

1. Technical Field

Aspects of this document relate generally to directional couplers. More specific implementations involve radio frequency (RF) directional couplers.

2. Background

Directional couplers are passive devices used to couple a predetermined proportion of a power signal in a first transmission line (main line) to a port so that the signal may be used in another circuit. Couplers allow sensing of power levels of the transmission line without directly connecting to the transmission line. Directional couplers also have the capability to monitor the direction of signal flow through the coupler and so measure forward and reverse powers plus allow the monitoring of phase between forward and reverse signals flowing through the coupler. Conventional directional couplers utilize one or more coupled lines located proximate a main transmission line, and a separation distance between the one or more coupled lines. The main transmission line may be designed to achieve a desired amount of input power that is sampled to the coupled port.

SUMMARY

Implementations of embedded directional couplers (directional couplers) may include: a main line formed of an electrically conductive material and having an input port and an output port, the main line coupled at least partially in and/or on a dielectric layer; a coupled line formed of an electrically conductive material and separated from the main line by a separation distance, the coupled line having a coupled port, the coupled line at least partially formed in and/or on the dielectric layer; an electrically conductive ground layer coupled with the dielectric layer and electrically isolated from the main line and the coupled line with the dielectric layer, and; a plurality of electrically conductive tuning elements at least partially encapsulated in the dielectric layer and arranged in a pattern, the plurality of electrically conductive tuning elements electrically isolated from the main line, the coupled line, and the electrically conductive ground layer using the dielectric layer, the plurality of electrically conductive tuning elements increasing a coupling coefficient and/or directivity of the directional coupler.

Implementations of embedded directional couplers may include one, all, or any of the following:

Each of the plurality of electrically conductive tuning elements may have a rectangular shape and/or a circular shape.

The pattern may be a regular pattern and/or a complex regular pattern.

The pattern may be an irregular pattern.

The main line may have a plurality of angular deviations between a first point of the main line and a second point of the main line, the coupled line may include a plurality of angular deviations between a first point of the coupled line and a second point of the coupled line, and an edge of the main line may be parallel with an edge of the coupled line from the first point of the main line to the second point of the main line.

A second electrically conductive ground layer may be coupled with the dielectric layer and electrically isolated from the main line, the coupled line, and the electrically conductive ground layer with the dielectric layer.

The separation distance may vary along a longest length of the main line.

The variation of the separation distance may create harmonic interference for an electromagnetic wave carried across the main line.

Implementations of embedded directional couplers (directional couplers) may include: a main line formed of an electrically conductive material and including an input port and an output port, the main line coupled at least partially in and/or on a dielectric layer; a coupled line formed of an electrically conductive material and separated from the main line by a separation distance, the coupled line including a coupled port, the coupled line at least partially formed in and/or on the dielectric layer; an electrically conductive layer coupled with the dielectric layer, wherein the electrically conductive layer is not grounded and is electrically isolated from the main line and the coupled line with the dielectric layer, and; a plurality of tuning elements included in the electrically conductive layer and arranged in a pattern, the plurality of tuning elements including one or more openings in the electrically conductive layer, the plurality of tuning elements increasing a coupling coefficient and/or directivity of the directional coupler.

Implementations of embedded directional couplers may include one, all, or any of the following:

A first electrically conductive ground layer may be coupled with the dielectric layer and electrically isolated from the main line and the coupled line with the dielectric layer.

A second electrically conductive ground layer may be coupled with the dielectric layer and electrically isolated from the main line, the coupled line, and the first electrically conductive ground layer with the dielectric layer.

The main line may be coupled with the dielectric layer at a first side of the main line and may be coupled with air at a second side of the main line opposite the first side of the main line, and the coupled line may be coupled with the dielectric layer at a first side of the coupled line and coupled with the air at a second side of the coupled line opposite the first side of the coupled line.

The electrically conductive layer may include an electrically conductive ground layer.

A second electrically conductive ground layer may be coupled with the dielectric layer and electrically isolated from the main line, the coupled line, and the electrically conductive layer with the dielectric layer.

One or more electrically conductive elements may be disposed within the one or more openings and electrically isolated from the electrically conductive layer with the dielectric layer.

Implementations of embedded directional couplers (directional couplers) may include: a main line formed of an electrically conductive material and including an input port and an output port, the main line coupled at least partially in and/or on a dielectric layer; a coupled line formed of an electrically conductive material and separated from the main line by a separation distance, the coupled line having a coupled port, the coupled line at least partially formed in and/or on the dielectric layer, and; an electrically conductive layer coupled with the dielectric layer and electrically isolated from the main line and the coupled line with the dielectric layer; wherein the electrically conductive layer is not grounded; wherein the electrically conductive layer overlaps with the main line in a first direction orthogonal to a largest planar surface of the electrically conductive layer, wherein the electrically conductive layer overlaps with the coupled line in a second direction orthogonal to the largest planar surface, and; wherein the electrically conductive layer increases a coupling coefficient and/or directivity of the directional coupler.

Implementations of embedded directional couplers may include one, all, or any of the following:

An electrically conductive ground layer may be coupled with the dielectric layer and electrically isolated from the main line, the coupled line, and the electrically conductive layer with the dielectric layer.

A second electrically conductive ground layer may be coupled with the dielectric layer and electrically isolated from the main line, the coupled line, the electrically conductive layer, and the electrically conductive ground layer with the dielectric layer.

The main line may be coupled with the dielectric layer at a first side of the main line and coupled with air at a second side of the main line opposite the first side of the main line, and the coupled line may be coupled with the dielectric layer at a first side of the coupled line and coupled with the air at a second side of the coupled line opposite the first side of the coupled line.

The first direction and the second direction may be collinear.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

Figure 1:
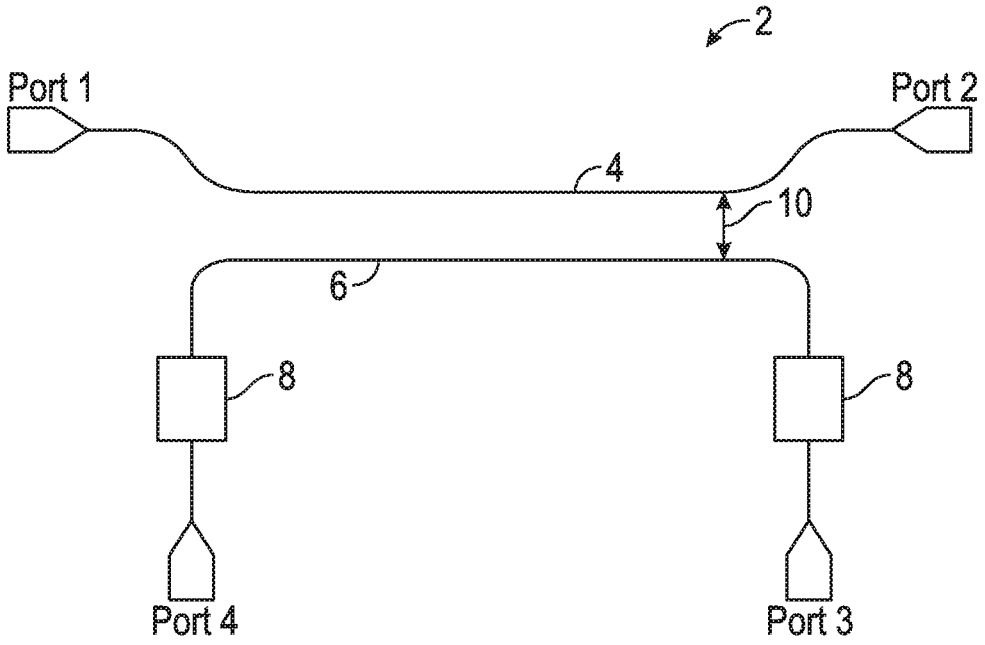
FIG. 1 is a top view of a conventional directional coupler.

This disclosure, its aspects and implementations, are not limited to the specific components, assembly procedures or method elements disclosed herein. Many additional components, assembly procedures and/or method elements known in the art consistent with the intended embedded directional couplers and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such embedded directional couplers and related methods, and implementing components and methods, consistent with the intended operation and methods.

Directional couplers may be used in a variety of applications and may have varying configurations. Directional couplers generally include a main line and a coupled line. The main line in many applications is a transmission line and the coupled line is separated from the transmission line using a predetermined separation distance. The main line is formed of an electrically conductive material and the coupled line is also formed of an electrically conductive material (these may be formed, by non-limiting example, using metals). The coupling line may be used to detect/sample incident and/or reflected transmission of the main line with hopefully minimal disturbance to the main line. Directional couplers may be used with transmission lines that use transmission frequencies such as microwave or radio frequency (RF), or other frequencies. All of the representative examples shown in the drawings are RF directional couplers, though they could be configured to be used with other wavelengths.

The main line and coupled line may be sized and positioned so that they are parallel over some specific multiple of a wavelength, such as a quarter wavelength in some applications, though in other implementations other multiples/fractions of a wavelength may be used. A coupling factor or coupling coefficient of a directional coupler is dependent, in part, on the separation distance. The shorter the separation distance, the more of the main line transmission that will be sampled to a coupled port of the coupled line. The transmission line signal may be designated as "input power" or Pi and the amount that is sampled to the coupled port may be designated "forward power" or Pf and the coupling coefficient C may be defined as $C=10 \log 10 (Pf/Pi)$. Common coupling coefficients include, for example, 3, 6, 10, 20, 30, 40, and 50 dB, though other coupling coefficients may be achieved through proper directional coupler design.

Directional couplers can be implemented using coaxial cables, lumped or discrete elements on a printed circuit board (PCB) or substrate carrier (such as discrete blocks coupled with connectors, solder pins, and using plastic chip carriers, ceramic carriers, or other chip carrier or circuit board materials), or may be implemented in silicon (Si) and other substrates using metals and dielectrics in an integrated passive device (IPD) type structure, and so forth. They may be implemented as sub-components of a larger assembly. FIG. 1, for example, shows a representative configuration that may be implemented using coaxial cable (though FIG. 1 could also represent an embedded design), where the directional coupler 2 includes a main line 4 having an input port (Port 1) and an output port (Port 2). A coupled line 6 includes a coupled port (Port 3) and an isolated port (Port 4) and is separated from the main line by a separation distance 10. Symmetric filters 8 are used on the coupled line, though these are optional. In implementations in which filters are used they may be used, among other things, to affect the coupling coefficient and/or directivity of the directional coupler, though other parameters may be altered to affect directivity and/or the coupling coefficient as will be described in further detail below.

In theory, when power is introduced at the input port it all appears at the output port (sometimes called the transmitted port or through port) except the portion that is sampled to the coupled port(s). In an "ideal" directional coupler any power reflected back from the output port would not appear on the coupled line. Ideal directional couplers do not exist, however, so that some backward power is coupled to the coupled line and is 180 degrees out of phase from the incident wave. This has a partial canceling effect on the coupled line and adds some uncertainty to the sampled measurement. "Directivity" may be defined as the ratio of forward to backward coupling and may be expressed as $D=10 \log 10 (Pf/Pb)$ where Pf is forward power and Pb is backward power. Higher directivity values mean that less backward power is sampled and uncertainty is accordingly reduced. Thus, it is generally desirable to have higher directivity so as to increase accuracy of sample measurements.

The main line and coupled line are generally separated from one another using a dielectric material, in some cases air (such is the case with "air-line" coaxial cable implementations). Other implementations use other dielectrics, and some implementations use air and one or more other dielectric materials. A ground line or ground layer may also be included and may be separated from the main line and coupled line using one or more dielectrics. In the case of coaxial implementations this could be implemented using a grounded line, the grounded line being electrically conductive but coupled with electrical ground, and running alongside the main and coupled lines within the cable but separated from each using air or some other dielectric material.

Referring now back to FIG. 1, and as has been discussed above, directional coupler 2 shown in FIG. 1 includes a main line 4 having an input port (Port 1) and an output port (Port 2). The coupled line 6 includes a coupled port (Port 3) and an isolated port (Port 4), and symmetric filters are included on the coupled line. The isolated port is generally isolated from the power entering the input port. Bidirectional couplers may be used in either direction depending on how the ports are coupled to external elements, so for example if the directional coupler of FIG. 1 is configured so that the power is applied at Port 2 and a load is coupled at Port 3, then Port 2 may act as the input port, Port 1 may act as the output port, Port 4 may act as the coupled port, and Port 3 may act as the isolated port. Any of the directional couplers disclosed herein may be configured as bidirectional couplers, though for brevity and ease of explanation each representative directional coupler discussed herein is assumed to have power applied to Port 1 (or P1) so that it is the input port, P2 or Port 2 is assumed to be the output port, Port 3 or P3 is assumed to be the coupled port and Port 4 or P4 is assumed to be the isolated port.

As described above, the representative directional coupler of FIG. 1 may be implemented using coaxial cable, where an applied power is applied at one end (Port 1) of the main line to appear at the other end (Port 2) and the coupled port (Port 3) is thus used to sample the applied power. The directional coupler of FIG. 1 could, alternatively, be implemented using an embedded design where the main and coupled lines and/or other elements are included (at least partially) within a semiconductor device package such as a chip carrier or semiconductor die package (such designs are herein referred to as "embedded directional couplers"). Embedded directional couplers may reduce the space in any given system compared to a system which uses coaxial cables or lumped/discrete elements to form a directional coupler.

Embedded directional couplers may be fabricated in a number of ways. Electrically conductive traces on a printed circuit board (PCB) element (such as formed of FR4 or some other board material) may be used to from embedded directional couplers. Other embedded directional couplers have integrated passive device (IPD) configurations using materials such as silicon (Si), sapphire, silicon-on-insulator (SOI), and so forth, and other configurations are possible as well. Many conventional embedded directional couplers have two-dimensional (2D) configurations, and examples of such 2D conventional embedded directional couplers may be represented by the examples of FIGS. 1-3.

Figure 2:
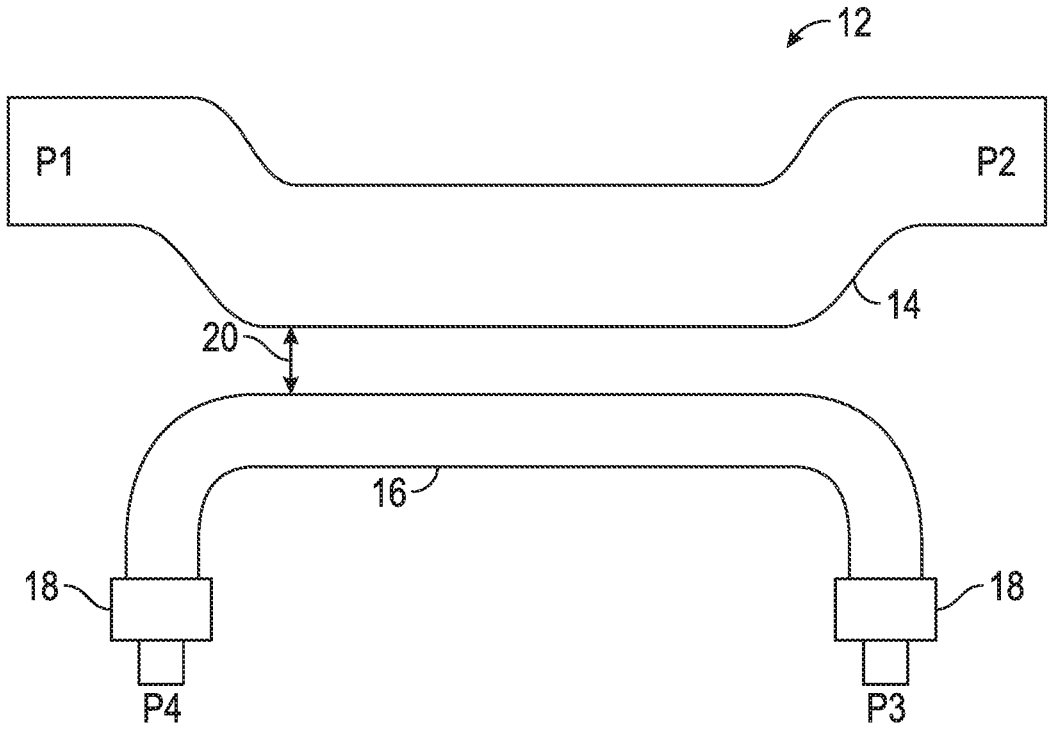
FIG. 2 is a top view of another conventional directional coupler.

If the directional coupler of FIG. 2 were implemented as an embedded directional coupler, then the conventional directional coupler 12 of FIG. 2 could be in many ways similar except that the electrically conductive traces used to form the main line 14 and coupled line 16 are noticeably wider. In other respects, however, the two are qualitatively similar. The main line of directional coupler 12 includes an input port P1 and an output port P2, the coupled line includes a coupled port P3 and an isolated port P4, and symmetrical filters 18 are included (though as indicted with respect to directional coupler 2, these may be excluded). The main line and coupled line are separated by a separation distance 20. The main line and coupled line of directional coupler 12 may be separated using a dielectric, such as air, or some other material. Additionally, one or more electrically conductive ground layers may be utilized and may be separated from the main and coupled lines using a dielectric.

Figure 3:
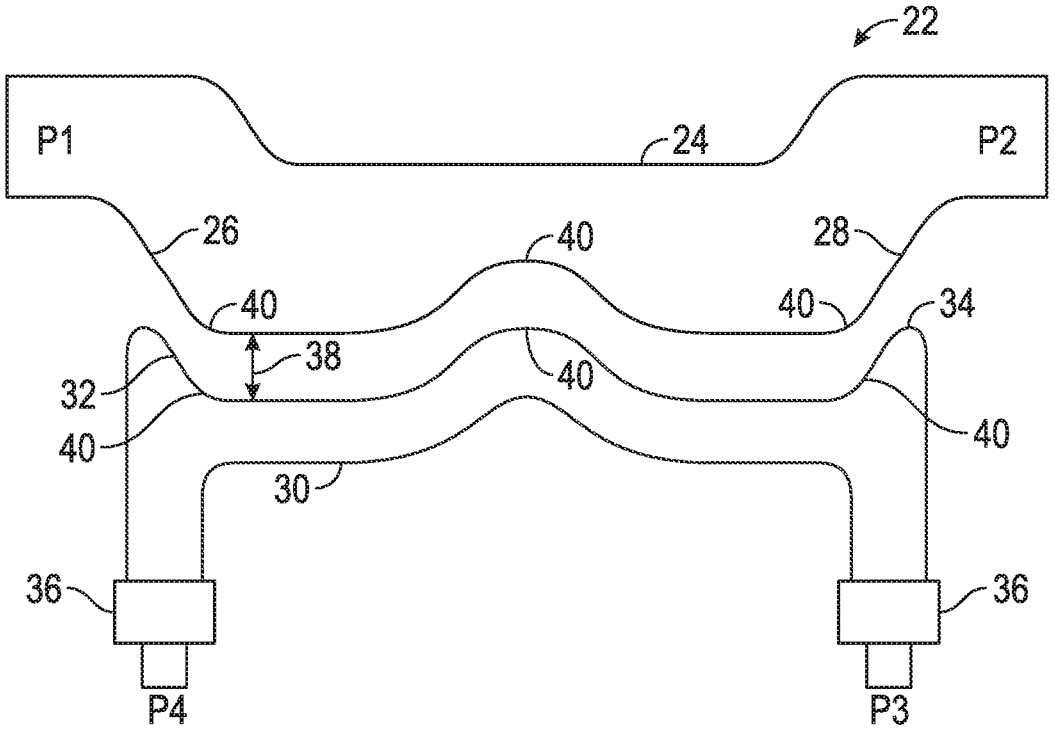
FIG. 3 is a top view of another conventional directional coupler.

FIG. 3 shows a representative example of a conventional directional coupler 22 that is in many ways similar to directional coupler 12 except that the main line 24 and coupled line 30 have matching geometric deviations. The main line includes an input port P1 and output port P2, but between a first point 26 and second point 28 includes a number of angular deviations 40 (these could also be called edge deviations). The coupled line includes a coupled port P3 and an isolated port P4, but between a first point 32 and second point 34 includes a number of angular deviations 40. The angular deviations of the main line and coupled line are matching so that the nearest edges of the main and coupled lines are parallel between the first point and second point of each line. The coupled line includes filters 36, which may be omitted as described above. There is a separation distance 38 between the main line and coupled line. Matching geometric/angular deviations such as those shown in FIG. 3 may, in implementations, increase the coupling coefficient and/or directivity of the directional coupler.

Figure 17:
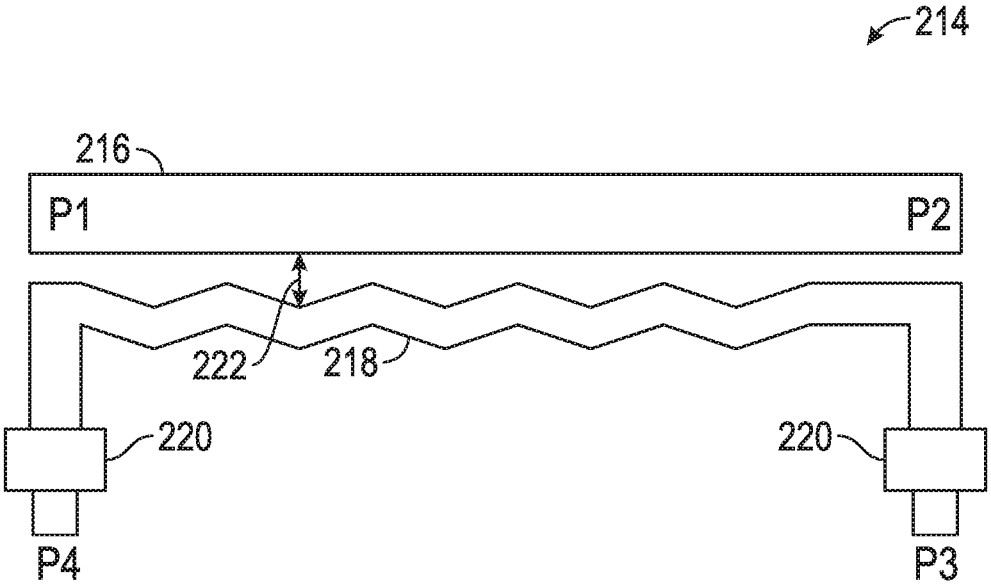
FIG. 17 is a top view of another implementation of an embedded directional coupler.

FIG. 17 shows a representative example of an embedded directional coupler (directional coupler) 214 that is in many ways similar to directional coupler 12 except that the main line 216 does not have geometric deviations while the coupled line 218 does. The main line includes an input port P1 and output port P2 and is straight between these two ports. The coupled line includes a coupled port P3 and an isolated port P4 and between these ports includes a number of angular deviations. The coupled line includes filters 220, which may be omitted as described above. There is a separation distance 222 between the main line and coupled line but, because of the geometric/angular deviations of the coupled line, the separation distance changes depending on where it is measured. The separation distance is accordingly modulated so that it varies. In implementations this variation in separation distance may increase the coupling coefficient and/or directivity of the directional coupler. It should also be noted that in other implementations the coupled line could be straight and the main line could include the geometric/angular deviations instead (or the lines could both include geometric/angular deviations, but non-matching, so that the separation distance still varies). The representative example of FIG. 17 may be implemented using dielectric layers, in ministrip configuration, in stripline configuration, and/or with the separation distance including or not including a vertical component, and with or without ground layers/plates, and so forth, as with other examples discussed herein.

Figure 4A:
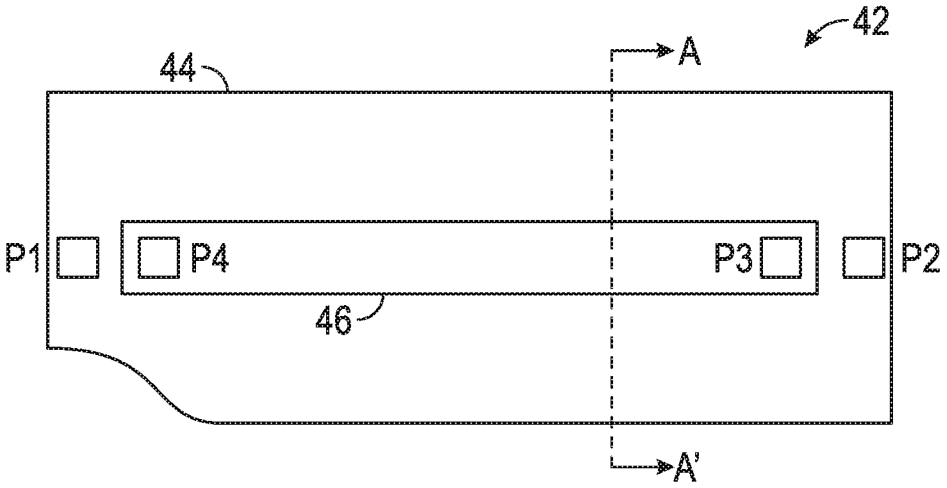
FIG. 4A is a top view of another conventional directional coupler.
Figure 4B:
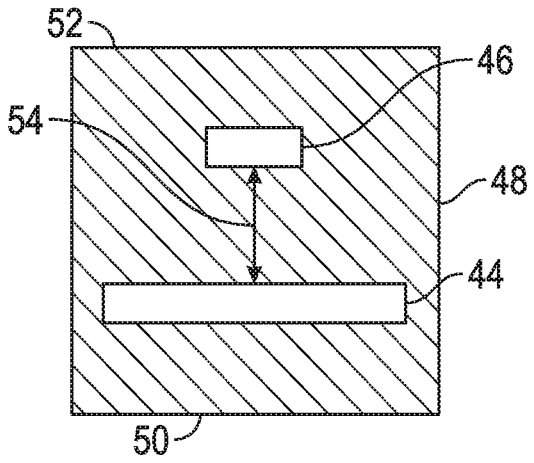
FIG. 4B is a side cross-section view of the directional coupler of FIG. 4A taken along line A-A'.

FIGS. 4A-4B show a representative example of a conventional directional coupler 42 that is in many ways similar to directional coupler 12 except that, instead of the main line and coupled line being horizontally distanced from one another, they are vertically distanced from one another. From a top view perspective, as seen in FIG. 4A, the coupled line thus appears over the main line. The main line and coupled line are shown in FIG. 4A without any other elements shown, for ease in viewing, but in the representative example of FIGS. 4A-4B the directional coupler 42 is actually formed by including the main line 44 and coupled line 46 within a dielectric layer 48, as seen in FIG. 4B. The dielectric layer has a first side 50 and a second side 52 opposite the first side, and the main line and coupled line are both located between the first and second side of the dielectric layer at the cross-section. The separation distance 54 is thus a vertical separation distance as the main line and coupled lines are vertically stacked. The main line includes an input port P1 and an output port P2 and the coupled line includes a coupled port P3 and an isolated port P4 as before. No filters are shown, but these could be included if desired.

Figure 5A:
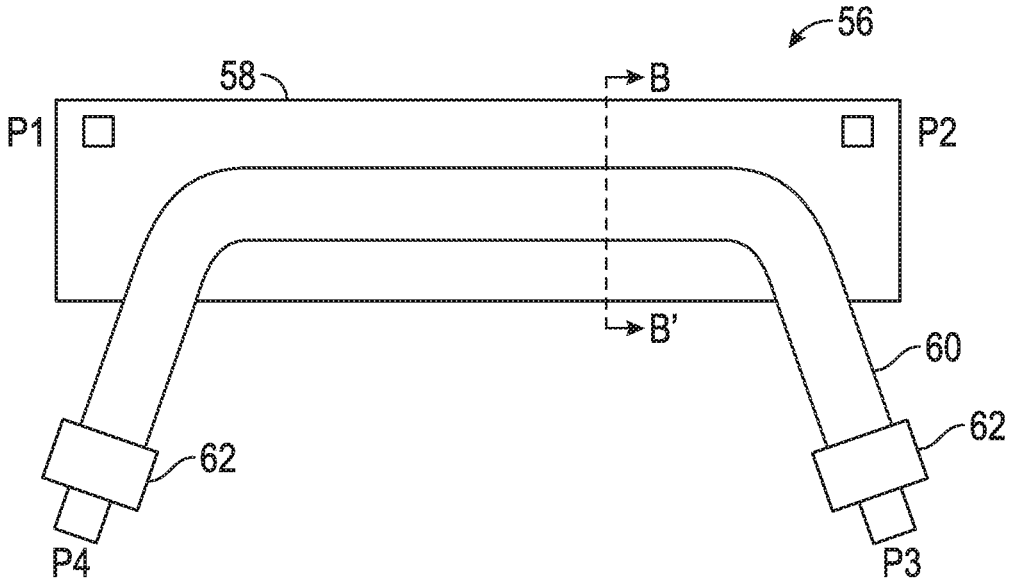
FIG. 5A is a top view of another conventional directional coupler.
Figure 5B:
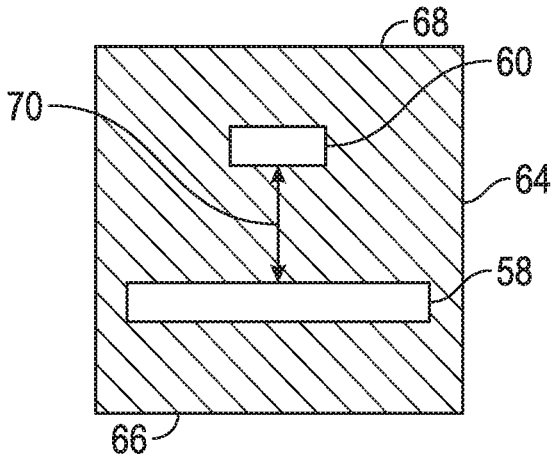
FIG. 5B is a side cross-section view of the directional coupler of FIG. 5A taken along line B-B'.

FIGS. 5A-5B show a conventional directional coupler 56 that is in many ways similar to the directional coupler 42 of FIGS. 4A-4B except only one linear portion of the coupled line 60 is fully vertically stacked over the main line 58, as seen in FIG. 5A. FIG. 5B shows that a cross-section view appears identical to FIG. 4B, however. The main line includes an input port P1 and an output port P2, and the coupled line includes a coupled port P3 and isolated port P4. Filters 62 are shown on the coupled line, though they may be excluded if desired. The dielectric layer 64 has a first side 66 and a second side 68 opposite the first side, and at the cross-section of FIG. 5B the main and coupled lines are fully enclosed within the dielectric layer and are separated from one another by a separation distance 70. The main and coupled lines are accordingly electrically isolated from one another (as in other examples shown herein) using the dielectric layer.

Figure 6:
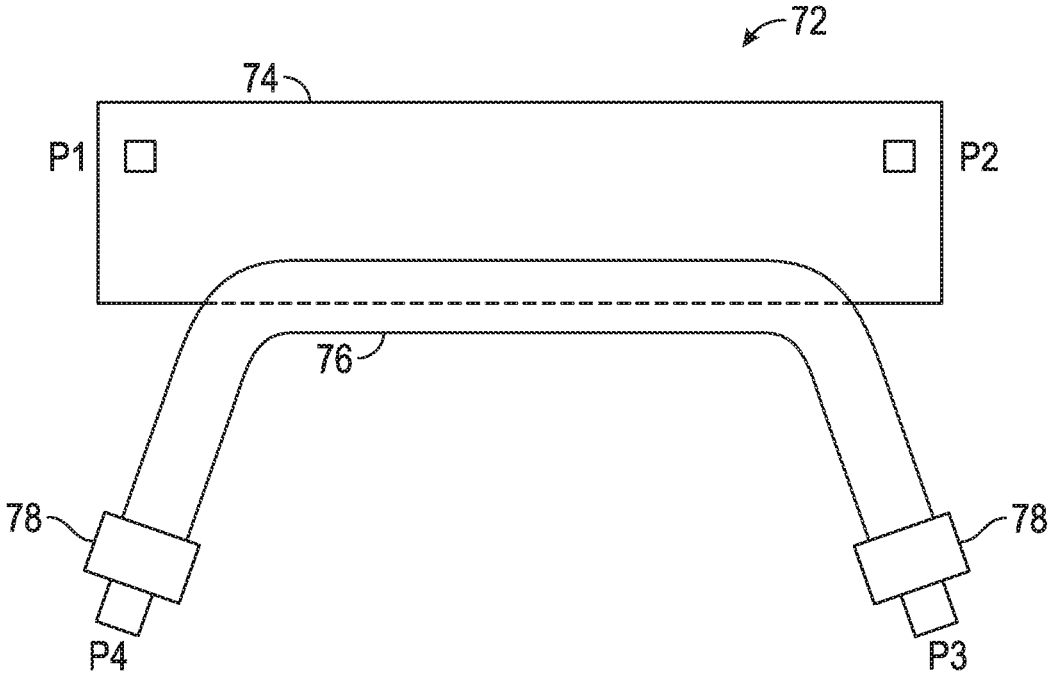
FIG. 6 is a top view of another conventional directional coupler.

FIG. 6 shows a conventional directional coupler 72 that is in many ways identical to the directional coupler 56 except that the longest linear portion of the coupled line is not fully vertically stacked over the main line, but instead only partially overlaps with it, as can be seen from the image. The longest linear portion of the coupled line may be enclosed within a dielectric layer, however, along with the main line, similar to the previous examples (between a first side of the dielectric layer and a second side of the dielectric layer opposite the first side). The main line 74 includes an input port P1 and an output port P2 and the coupled line 76 includes a coupled port P3 and an isolated port P4. Filters 78 are included on the coupled line, though they can be excluded as with other examples, and the main line and coupled line will be separated from one another vertically by a separation distance.

The above-described conventional directional couplers are seen to have a variety of variables that may be altered to affect the functioning of the directional couplers. Shifting the position of the coupled line and main line, for example, so that they are separated horizontally or vertically, or so that they fully or only partially overlap, and/or creating matching geometric/angular deviations, all may affect the coupling coefficient and directivity of the directional coupler. Similar variables may be altered with the embedded directional couplers (directional couplers) that will be described below. Comparing FIGS. 5 and 6 of course illustrates the fact that the main line and coupled line may be situated, relative to one another, having any degree of overlap, or only partial overlap.

Figure 7:
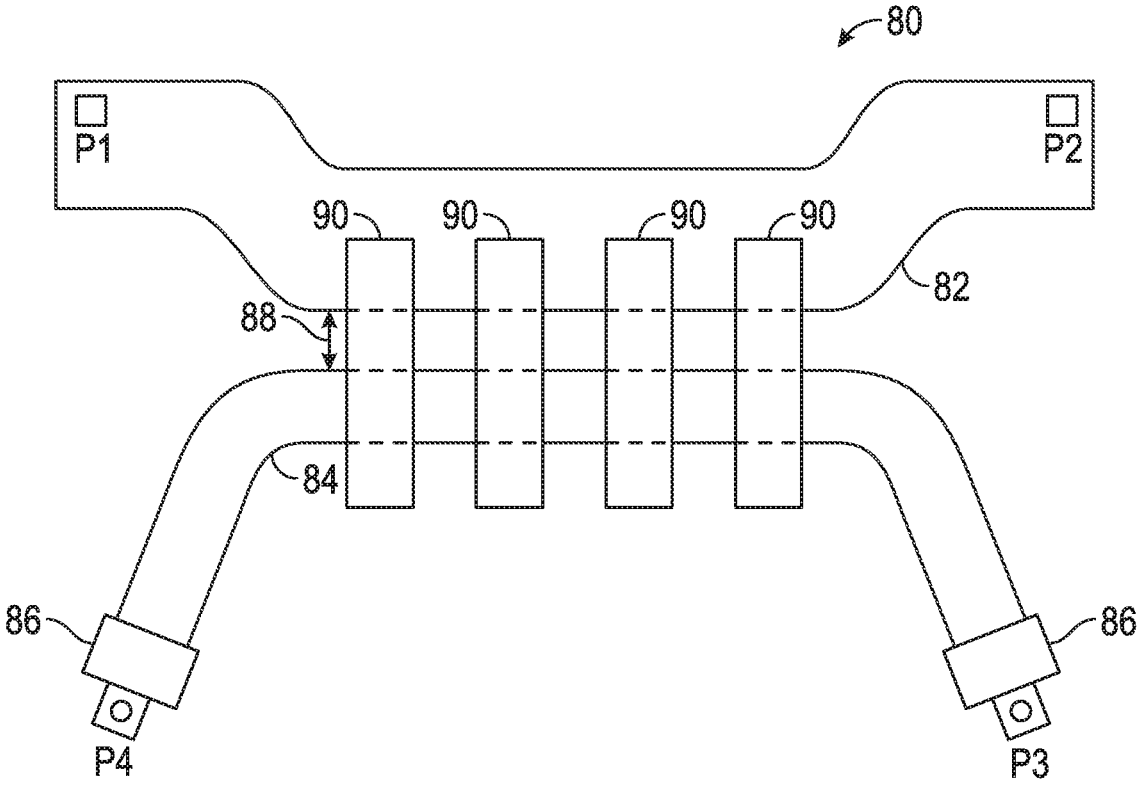
FIG. 7 is a top view of an implementation of an embedded directional coupler.

Referring now to FIG. 7, a representative example of an embedded directional coupler (directional coupler) 80 is shown. The directional coupler includes a main line 82 having an input port P1 and an output port P2. A coupled line 84 is also included and includes a coupled port P3 and an isolated port P4. Filters 86 are included on the coupled line though they may be excluded if desired, as with other examples. The main line and coupled line are located in the same horizontal plane but spaced from one another horizontally by a separation distance 88. Directional coupler 80 is seen to have a configuration fairly similar to that of the directional coupler of FIG. 2, except a plurality of electrically conductive tuning elements (tuning elements) 90 are also included. The tuning elements are formed of an electrically conductive element, such as a metal, and in the representative example they are seen to each have a rectangular shape seen from above (they would have a rectangular cuboid three-dimensional shape seen from a perspective view) and are organized into a regular pattern. They are seen to be aligned in a row that is parallel with a longest length of the main line and a longest length of the coupled line, though the tuning elements themselves are substantially perpendicular to that longest length.

Figure 18:
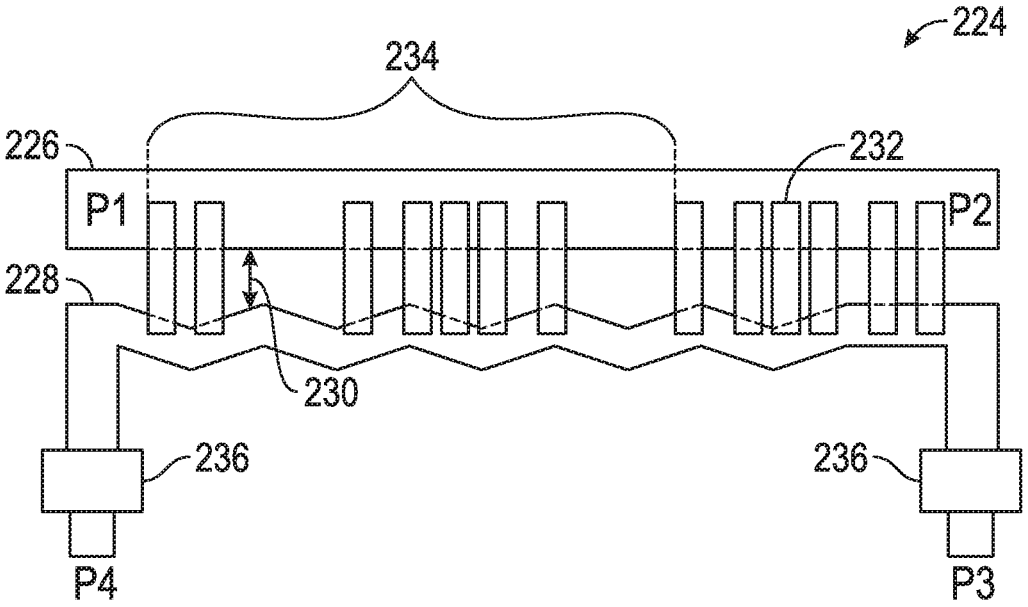
FIG. 18 is a top view of another implementation of an embedded directional coupler.

FIG. 18 shows a representative example of an embedded directional coupler (directional coupler) 214 that is in many ways similar to directional coupler 214 except including floating electrically conductive tuning elements (tuning elements) 232. The tuning elements are formed of an electrically conductive element, such as a metal, and in the representative example they are seen to each have a rectangular shape seen from above (they would have a rectangular cuboid three-dimensional shape seen from a perspective view) and are organized into an irregular pattern 234. The term "irregular pattern" as used herein is a configuration in which the spacing of tuning elements cannot be described/recreated as a repeated series of any single subset of tuning element spacings—in this way the spacing is not organized in a repeating pattern. Such is the case with FIG. 18, in which there are four spacing sizes represented, which we could designate 1-4 with 1 being the smallest and 4 being the largest. Using this designation, element number 234 shows an irregular pattern having spacing 2-4-3-1-1-3-4. This is not a repeating pattern but is an irregular pattern. The entire pattern from P1 to P2 is also an irregular pattern. Beginning from the left hand side proximate P1, the spacing between tuning elements would have an irregular pattern as follows: 2-4-3-1-1-3-4-3-1-1-3-2. It may be seen that no single subset of this sequence could be repeated to reproduce the overall sequence, so that it is an "irregular pattern" as defined herein.

In other implementations directional couplers could have "complex regular" patterns. "Complex regular pattern" as used herein is a pattern including more than one spacing size but having a sequence which can be described/recreated as a repeated series of a single subset of tuning element spacings. For example, using the same spacing sizes 1-4 designated above, a sequence of 1-2-3-4-3-2-1-1-2-3-4-3-2-1 would be a complex regular pattern as defined herein because it could be recreated by repeating the subset "1-2-3-4-3-2-1" two times. A pattern of 1-2-3-4-3-2-1-1-2-3-4- (excluding the last three spacings 3-2-1 because excluding the last three tuning elements) would be a "truncated complex regular pattern" which is considered herein a subset of a "complex regular pattern." In any case, a complex regular pattern (including a truncated complex regular pattern) and/or an irregular pattern of tuning elements may in implementations increase the coupling coefficient and/or directivity of the directional coupler. A "regular pattern" (i.e., not complex) as used herein is defined as a pattern wherein all spacings between tuning elements along one direction are equal (as with FIG. 7). The terms "regular pattern," "complex regular pattern," irregular pattern," and "truncated complex regular pattern" are all subsets of "pattern" as used herein.

As with directional coupler 214, directional coupler 224 includes a main line 226 which does not have geometric deviations while the coupled line 228 does. The main line includes an input port P1 and output port P2 and is straight between these two ports. The coupled line includes a coupled port P3 and an isolated port P4 and between these ports includes a number of angular deviations. The main line and coupled line are located in the same horizontal plane. The tuning elements are seen to be aligned in a row that is parallel with a longest length of the main line (i.e. they are all aligned in the y-direction though spacing is irregular in the x-direction) and the tuning elements are substantially perpendicular to that longest length. In other implementations the tuning elements could be staggered from a y-direction alignment (i.e., staggered in the y-direction) using staggering that has any pattern, regular pattern, complex regular pattern, truncated complex regular pattern, or irregular pattern. The tuning elements are aligned in the z direction (into the page) but they could be staggered and/or including any pattern type along the z direction.

The coupled line includes filters 236, which may be omitted as described above. There is a separation distance 230 between the main line and coupled line in the horizontal plane but, because of the geometric/angular deviations of the coupled line, the separation distance changes depending on where it is measured. The separation distance is accordingly modulated so that it varies. This modulation may create harmonic interference for a wave being carried across the main line. In implementations this variation in separation distance may increase the coupling coefficient and/or directivity of the directional coupler. It should also be noted that in other implementations the coupled line could be straight and the main line could include the geometric/angular deviations instead (or the lines could both include geometric/angular deviations, but non-matching, so that the separation distance still varies). The representative example of FIG. 18 may be implemented using dielectric layers, in ministrip configuration, in stripline configuration, and/or with the separation distance including or not including a vertical component, and with or without ground layers/plates, and so forth, as with other examples discussed herein. The floating tuning elements 232 are electrically isolated from the main line, the coupled line, and any ground plates/layers through a dielectric layer. It is also noted here that, for reticulated openings described with respect to other implementations (i.e., wherein the tuning elements are openings in an electrically conductive layer), although only regular patterns of openings are shown in the drawings, other implementations could include regular, complex regular, truncated complex regular, and/or irregular pattern(s) in the x, y, and/or z directions. Similarly, any floating tuning elements formed of floating electrically conductive elements may be organized into any regular, complex regular, truncated complex regular, and/or irregular pattern(s) in the x, y, and/or z directions, and the pattern may in implementations increase the coupling coefficient and/or directivity of the directional coupler. The x and y directions are directions lying in the plane of the paper (x being left and right and y being up and down) for the top-view drawings and the z directions are into and out of the paper for top-view drawings.

The tuning elements are "floating" elements in that they are included in or on the dielectric material (not shown in FIG. 7 for ease of viewing the other elements) but they are not in any way electrically connected with the main line or with the coupled line. Additionally, an electrically conductive ground layer may be coupled with the dielectric layer and the floating tuning elements in implementations would not be electrically connected with the ground layer. Each of the tuning elements may, for example, be completely encased within the dielectric layer.

Figure 16:
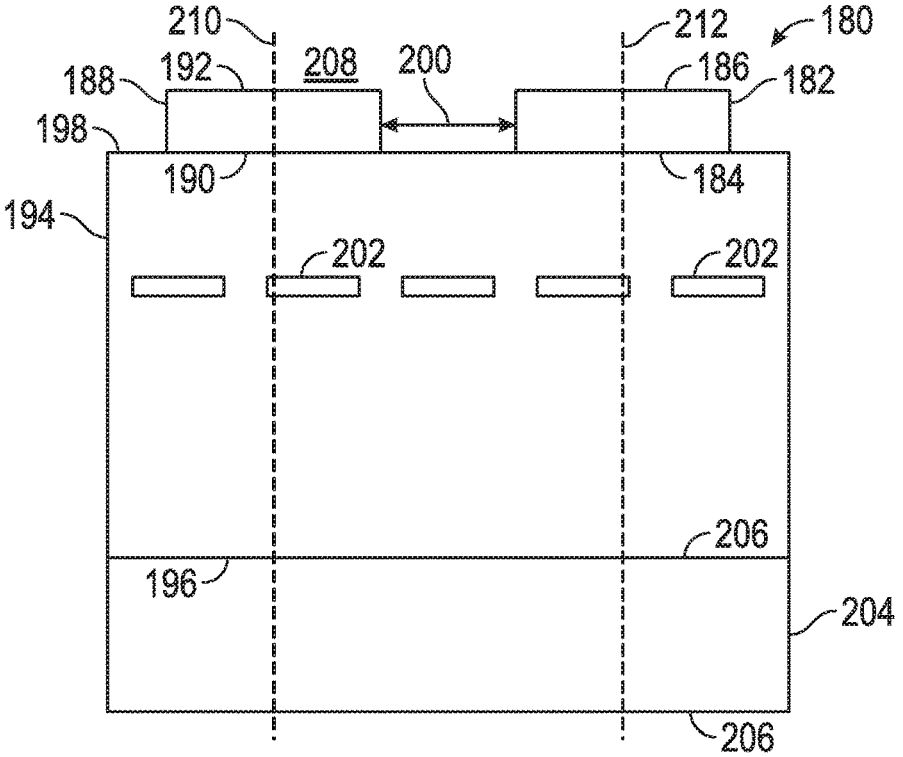
FIG. 16 is a side cross-section view of another implementation of an embedded directional coupler.

For example, FIG. 16 is a representative example of an embedded directional coupler (directional coupler) 180 configuration that the directional coupler 80 could have. FIG. 16 is a cross-section view of a directional coupler 180 which is seen to include a main line 182 and a coupled line 188 similar to other directional couplers disclosed herein. The main line has a first side 184 and a second side 186 opposite the first side. The coupled line has a first side 190 and a second side 192 opposite the first side. A dielectric layer 194 is included and has a first side 196 and a second side 198 opposite the first side.

An electrically conductive ground layer 204 is coupled at the first side of the dielectric layer and the main line and coupled line are seen to both be coupled at the second side of the dielectric layer. The first side of the main line abuts the dielectric layer while the second side of the main line is coupled with air 208. The first side of the coupled line abuts the dielectric layer while the second side of the dielectric layer is coupled with the air 208. The main line and coupled line are separated by a separation distance 200.

The configuration shown in FIG. 16 where the main line and coupled line are coupled atop a dielectric layer, and the dielectric layer is coupled atop an electrically conductive ground layer, is a microstrip configuration. In the microstrip configuration the main line and coupled line are surrounded with dielectric materials but the dielectric materials include the dielectric layer on one side of the main line and coupled line and air on the other side of the main line and coupled line. The main line and coupled line and the electrically conductive ground layer are all formed of electrically conductive materials, and they may be formed of metals.

FIG. 16 also shows that the embedded directional coupler 180 includes a plurality of electrically conductive tuning elements (tuning elements) 202. The tuning elements 202 are formed of one or more electrically conductive materials, such as one or more metals, and are "floating" in that they are not electrically connected with the main line, the coupled line, or the electrically conductive ground layer. In the implementation shown the plurality of tuning elements are fully enclosed in the dielectric layer and are electrically isolated from the main line, the coupled line, and the electrically conductive ground layer using the dielectric layer. Likewise, the main line and the coupled line are electrically isolated from the tuning elements and from the electrically conductive ground layer using the dielectric layer.

The tuning elements of directional coupler 180 have a configuration different than that shown in FIG. 7 though they are arranged in a regular pattern. The tuning elements of FIG. 16 are formed of circular elements such as those shown in FIG. 9, which will be described hereafter. It should be understood that a number of characteristics of directional coupler 180 may be altered to vary properties of the directional coupler. The separation distance between portions of the coupler could be increased or decreased, the sizes, widths, lengths, shapes, etc., of the main line and/or coupled line could be altered. The main line and coupled line could have matching geographic/angular deviations as described above with respect to other implementations. The size of the tuning elements, spacing of the tuning elements apart from one another, and spacing of the tuning elements apart from the main and coupled lines could be altered. Other characteristics could also be altered to vary parameters of the directional coupler.

The presence of the tuning elements 202 increases the directivity and/or the coupling coefficient of the directional coupler 180 above what the directivity and/or coupling coefficient would be without the tuning elements. It may be seen from FIG. 16 that the main line overlaps with the tuning elements and with the electrically conductive ground layer in a first direction 210 and that the coupled line overlaps with the tuning elements and with the electrically conductive ground layer in a second direction 212. The first direction and second direction are parallel but are not collinear, and both are seen to be orthogonal to a largest planar surface 206 (of which there are two) of the electrically conductive ground layer 204.

Figure 15:
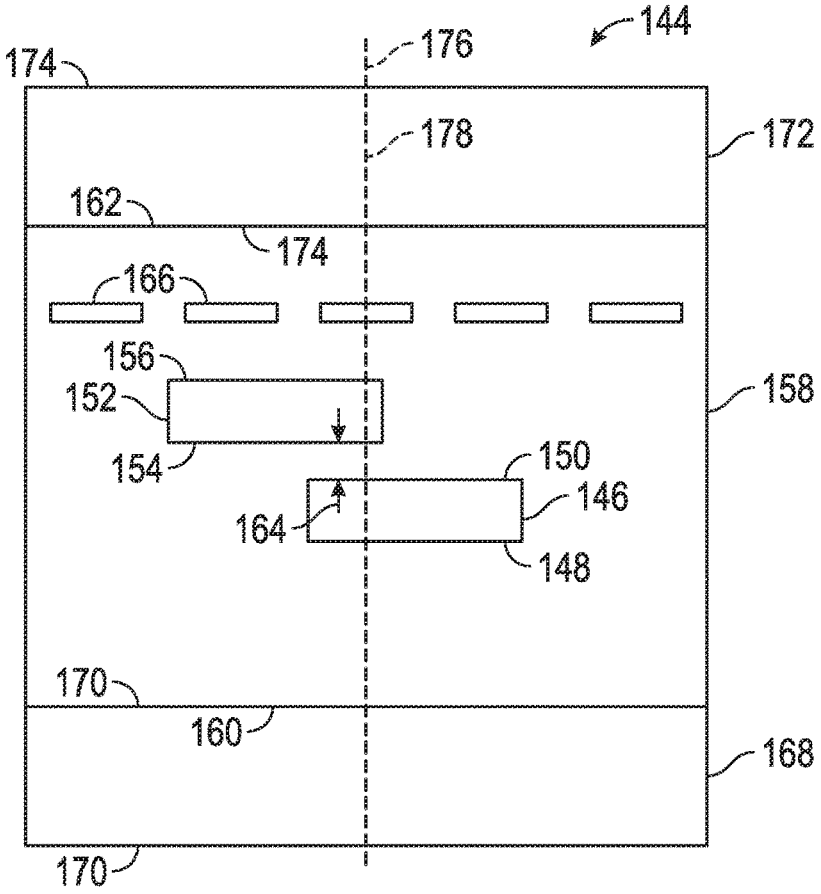
FIG. 15 is a side cross-section view of an implementation of an embedded directional coupler.

FIG. 16 is described above as having a microstrip configuration. FIG. 15 is a representative illustration of an embedded directional coupler (directional coupler) 144 that is in some ways similar to the directional coupler of FIG. 16 but which has a stripline configuration. In some implementations of a stripline configuration the main and coupled lines are embedded within a dielectric layer and a second ground plate is included so that the main and coupled lines are located between two ground layers. Thus, referring to FIG. 15, directional coupler 144 includes a main line 146 having a first side 148 and a second side 150 opposite the first side. A coupled line 152 includes a first side 154 and a second side 156 opposite the first side.

At the cross-section of FIG. 15 the main line and coupled line are each seen to be fully embedded within the dielectric layer 158 so that the first side and second side of the main and coupled lines are all abutting the same dielectric layer 158. The dielectric layer has a first side 160 and a second side 162 opposite the first side. A first electrically conductive ground layer 168 is coupled at the first side of the dielectric layer and a second electrically conductive ground layer 172 is coupled at the second side of the dielectric layer.

The main line and coupled line are seen to be vertically stacked and to partially, but not fully, overlap horizontally, so that they are separated by a separation distance 164. This could be altered in various implementations so that the main line and coupled line are separated only horizontally (as in FIG. 16) or so that they fully vertically overlap (as in FIGS. 4B, 5B). A plurality of electrically conductive tuning elements (tuning elements) 166 are included in the dielectric layer and are floating in that they are electrically isolated from the main line, the coupled line, and the electrically conductive ground layers 168/172 using the dielectric layer. The electrically conductive ground layers are electrically isolated from each other with the dielectric layer and are electrically isolated from the main line and coupled line with the dielectric layer. The main line and coupled line are further electrically isolated from one another with the dielectric layer.

The plurality of electrically conductive tuning elements (tuning elements) 166 are shown above the main line and coupled line in FIG. 15 but of course they could be located below the main line and coupled line. The tuning elements in this implementation are formed of circular elements similar to FIG. 9 which will be described hereafter. Many characteristics of directional coupler 144 could be altered to alter parameters of the directional coupler, and the presence of the tuning elements increases the directivity and/or coupling coefficient of the directional coupler above what the directivity and/or coupling coefficient would be without the tuning elements. The main line, coupled line, ground layers, and tuning elements of directional coupler 144 are all formed of electrically conductive materials, such as metals. The electrically conductive ground layers are seen to overlap with the tuning elements and with the main line in a first direction 176 and the electrically conductive ground layers overlap with the tuning elements and with the coupled line in a second direction 178. The first direction and second direction in FIG. 15 are seen to be parallel or substantially parallel and, further, collinear in various implementations. The first direction and second direction are seen to be orthogonal or substantially orthogonal to the largest planar surface 170 (of which there are two) of the electrically conductive ground layer 168 and orthogonal to the largest planar surface 174 (of which there are two) of the electrically conductive ground layer 172.

Figure 8:
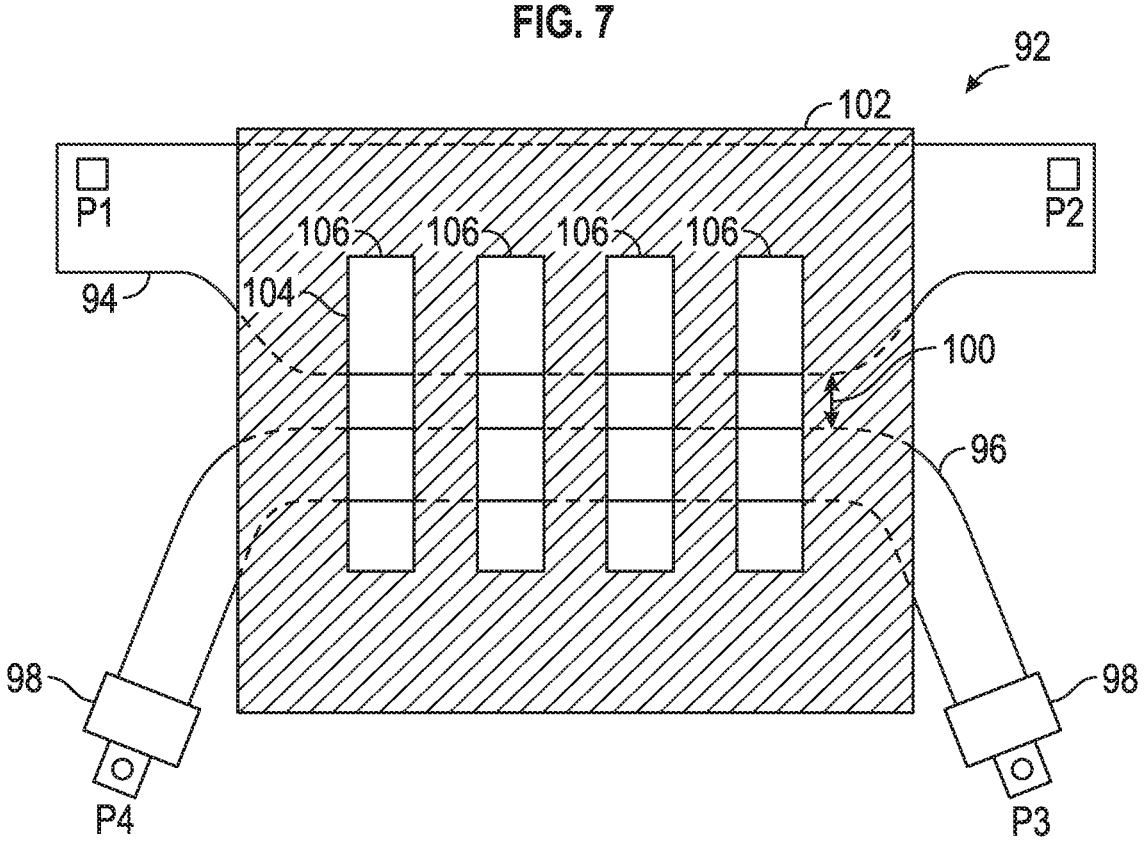
FIG. 8 is a top view of another implementation of an embedded directional coupler.

Referring now to FIG. 8, a representative example of an embedded directional coupler (directional coupler) 92 is shown. The main line 94 and coupled line 96 are seen to have a configuration somewhat similar to FIG. 2. The main line has an input port P1 and an output port P2 and the coupled line has a coupled port P3 and an isolated port P4. Filters 98 are included on the coupled line but, as with other directional couplers described herein, may be excluded if desired. The main line and coupled line are separated by a separation distance 100. An electrically conductive layer (layer) 102 is included and overlaps with the main line and coupled line. The electrically conductive layer 102 includes tuning elements 104 which are openings 106 arranged into a regular pattern.

FIG. 8 shows that, to some extent, the electrically conductive layer is a "negative" of the tuning elements shown in FIG. 7. Instead of a plurality of rectangular electrically conductive elements arranged in a regular pattern, the tuning properties of the tuning elements of directional coupler 92 are achieved by using a rectangular, electrically conductive plate which includes a plurality of rectangular openings arranged into a regular pattern. The rectangular openings overlap with the main line and the coupled line.

The dielectric layer is not shown in FIG. 8 but, referring to FIG. 16, the directional coupler 92 could be arranged into the microstrip configuration shown in FIG. 16 except with the tuning elements 202 replaced with the tuning elements 104 (in other words replaced with an electrically conductive layer having openings arranged in a regular pattern). In implementations the entire electrically conductive layer 102 may be encapsulated in the dielectric layer and would be a floating element in the sense that it would be electrically isolated from the main line, the coupled line, and the electrically conductive ground layer using the dielectric layer. The electrically conductive layer is formed of an electrically conductive material such as, by non-limiting example, a metal.

On the other hand, the directional coupler 92 could be arranged into the stripline configuration similar to that shown in FIG. 15 except with the tuning elements 166 replaced with the tuning elements 104 (in other words replaced with an electrically conductive layer having openings arranged in a regular pattern). The entire electrically conductive layer 102 may be encapsulated in the dielectric layer and would then be a floating element in the sense that it would be electrically isolated form the main line, the coupled line, and both electrically conductive ground layers using the dielectric layer. The electrically conductive layer could be located above or below the main line and coupled line. The main line and coupled line could be arranged in the same horizontal plane, or could partially overlap vertically as in FIG. 15 or could fully overlap vertically as in other implementations. Geometric/angular deviations may be included, and elements/characteristics described above with respect to other directional couplers could be included in directional coupler 92 to achieve desired properties. The tuning elements 104 increase the coupling coefficient and/or directivity of the directional coupler above what the coupling coefficient and/or directivity would be without the tuning elements.

The openings 106 are shown in the example to be rectangular openings arranged all in a single row. In other implementations they could be rectangular openings arranged in rows and columns, square openings arranged in a single row or in rows and columns, circular openings arranged in a single row or arranged in rows and columns, or any other regular or irregular closed shape for an opening arranged in a single row or arranged in rows and columns. In other implementations, electrically conductive elements could be placed within the openings. For example, rectangular floating elements, smaller in size than the openings but placed so that they are coplanar with the openings, could be utilized. Other shapes could be used, such as circular elements inside of rectangular openings, or rectangular elements inside of circular openings, etc., and could be simulated and/or experimented with to determine which provides the most desirable tuning characteristics for a given application.

Figure 9:
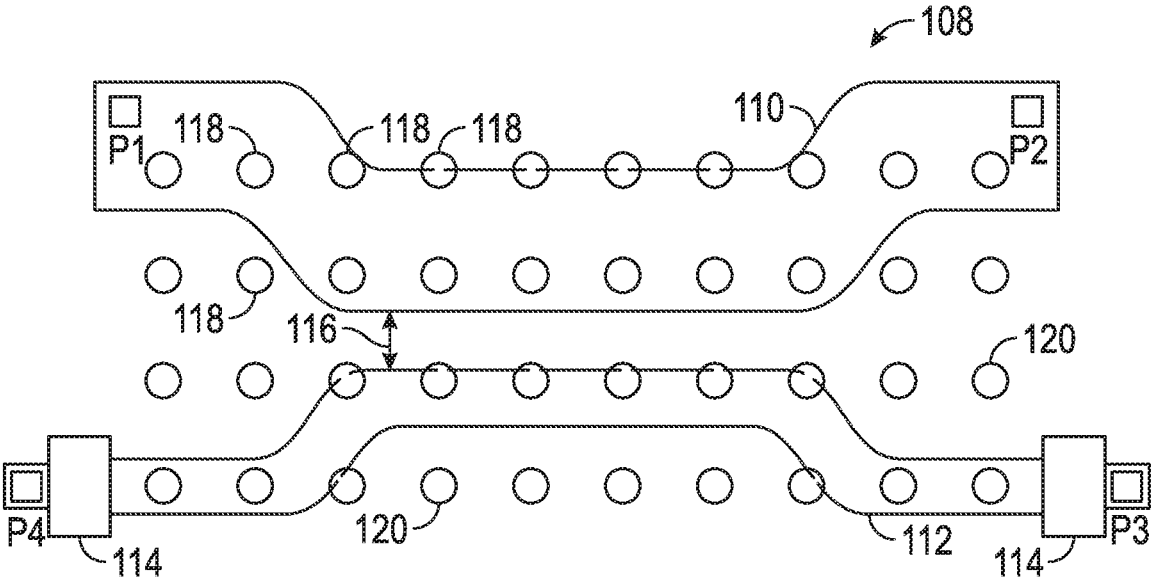
FIG. 9 is a top view of another implementation of an embedded directional coupler.

FIG. 9 shows another representative example of an embedded directional coupler (directional coupler) 108. A main line 110 is included and has an input port P1 and an output port P2. The coupled line 112 has a coupled port P3 and an isolated port P4. The coupled line includes filters 114, though these are optional, and the coupled line is separated from the main line by a separation distance 116. A plurality of electrically conductive tuning elements (tuning elements) 118 are included, and in the representative example they are seen to be floating circular elements 120 arranged in a regular pattern. The dielectric layer is not shown in FIG. 9, but the reader may envision either of the configurations of FIGS. 15-16 being implemented so that the directional coupler 108 could be implemented using a stripline (FIG. 15) or a microstrip (FIG. 16) configuration. In the stripline (FIG. 15) configuration the main and coupled lines may be somewhat vertically overlapped as shown in FIG. 15, or horizontally parallel as in FIG. 16, or fully vertically overlapped.

The floating circular elements 120 are electrically conductive but are electrically isolated from the main line, the coupled line, and any electrically conductive ground layers using the dielectric layer. Any electrically conductive ground layers are electrically isolated from the main line and coupled line using the dielectric layer (and if more than one electrically conductive ground layer is used these are electrically isolated from one another using the dielectric layer), while the main line and coupled line are electrically isolated from one another using the dielectric layer and/or using air. The floating circular elements increase the coupling coefficient and/or directivity of the directional coupler in ways like those disclosed herein.

Figure 10:
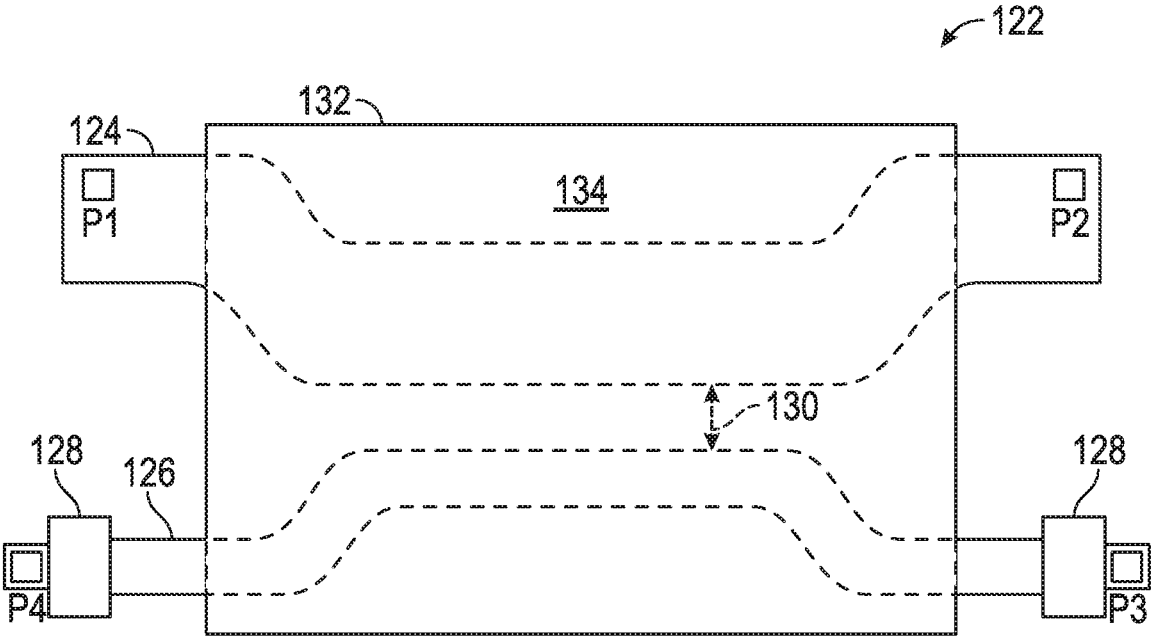
FIG. 10 is a top view of another implementation of an embedded directional coupler.

FIG. 10 shows a representative example of another embedded directional coupler (directional coupler) 122. A main line 124 includes an input port P1 and an output port P2. A coupled line 126 is separated from the main line by a separation distance 130 and includes a coupled port P3 and an isolated port P4. The coupled line includes filters 128 though these are optional. An electrically conductive layer (layer) 132 is shown and has a largest planar surface 134 (of which there are two). The dielectric layer is not shown in FIG. 10 but, referring to FIGS. 15-16, the directional coupler could have the configurations of FIGS. 15-16 except with the tuning elements 166/202 replaced with the electrically conductive layer. In this implementation the electrically conductive layer overlaps with the main line in a first direction orthogonal to the largest planar surface and overlaps with the coupled line in a second direction orthogonal to the largest planar surface. The first direction and second direction are not collinear though they are parallel—but naturally if the main line and coupled line were at least partially vertically stacked then the first direction second direction could be collinear.

Figure 11:
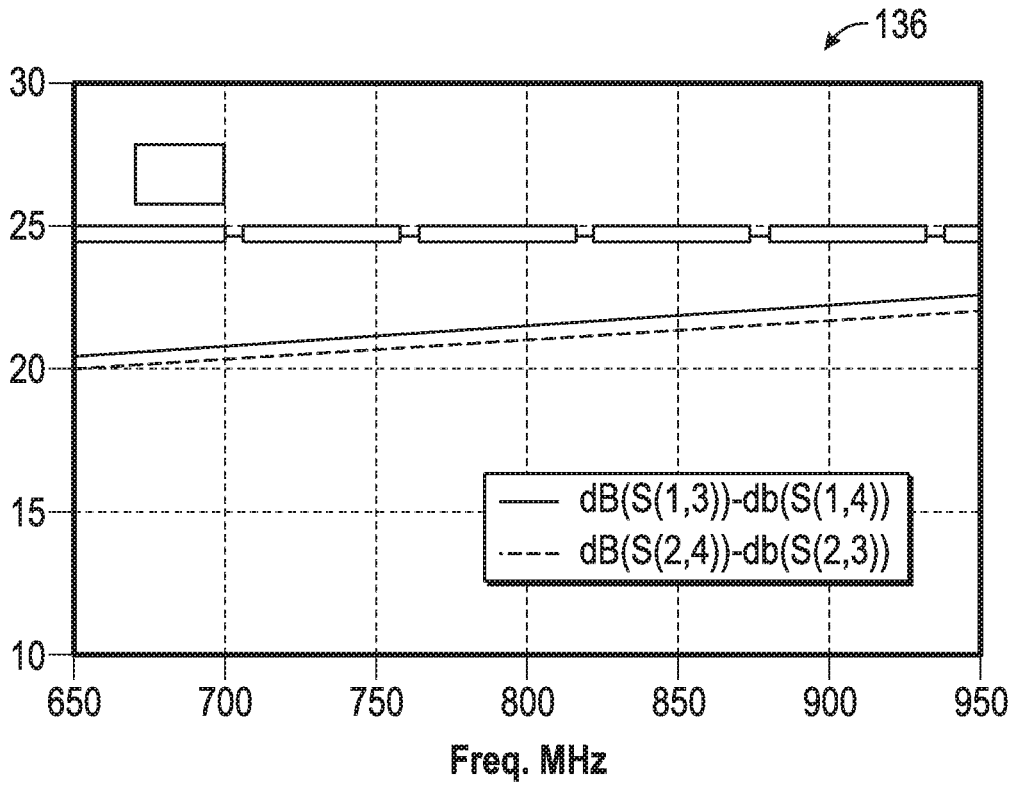
FIG. 11 is a graph representing behavior of an embedded directional coupler.
Figure 12:
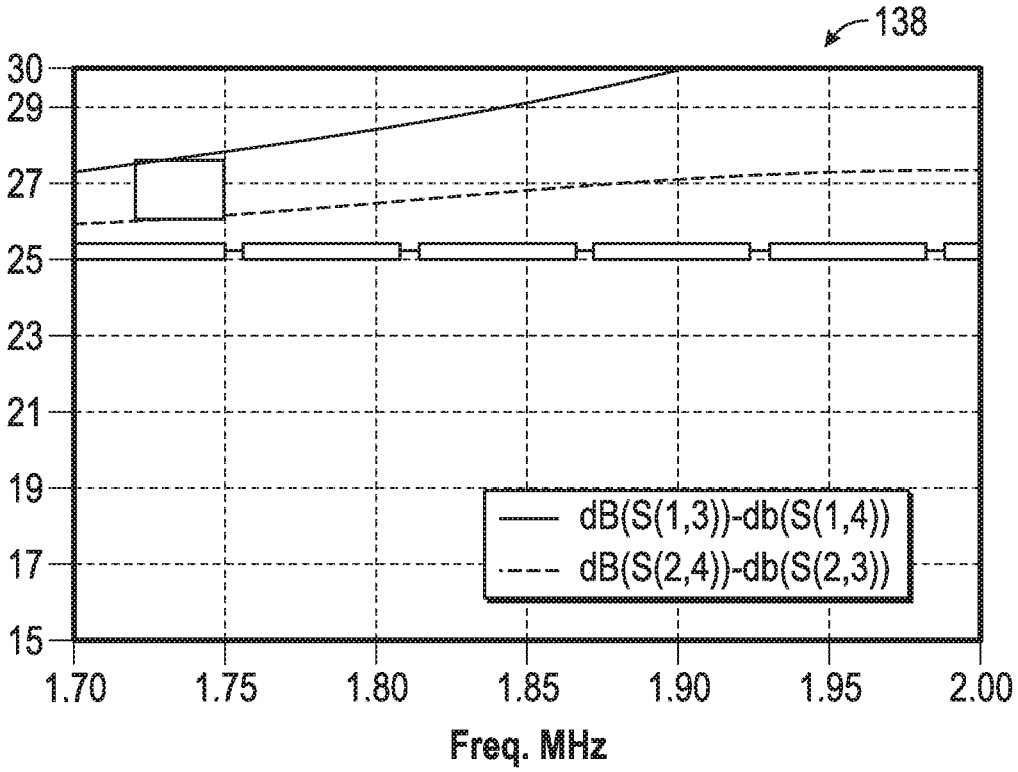
FIG. 12 is another graph representing behavior of an embedded directional coupler.

FIGS. 11-14 show graphs that represents simulated characteristics of directional couplers. FIG. 11 shows a graph 136 that representatively illustrates simulated passband directivity in dB between frequencies of 650-950 MHz and FIG. 12 shows a graph 138 that representatively illustrates simulated passband directivity in dB between frequencies of 1.70 and 2.00 MHz, both for a directional coupler having a general configuration similar to that of directional coupler 80 (including filters) previously described with rectangular floating tuning elements except that the rectangular floating elements were staggered so that there were two overlapping rows (when viewed from above) and the rows were offset so that none of the floating elements were contacting one another.

Figure 13:
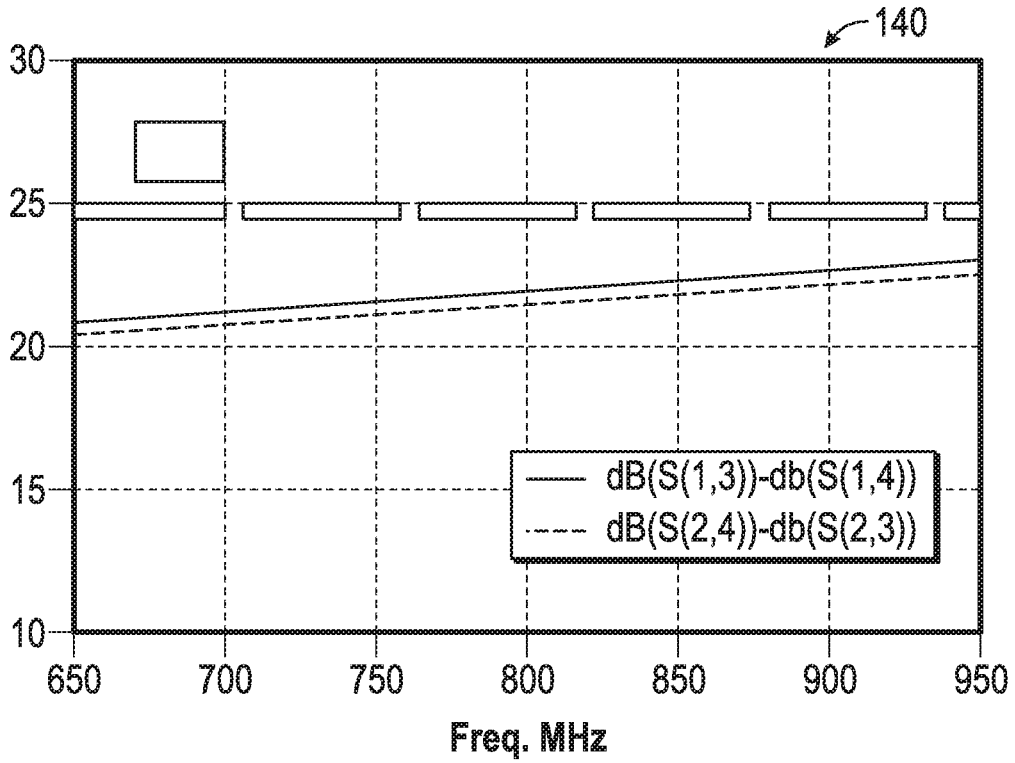
FIG. 13 is another graph representing behavior of an embedded directional coupler.
Figure 14:
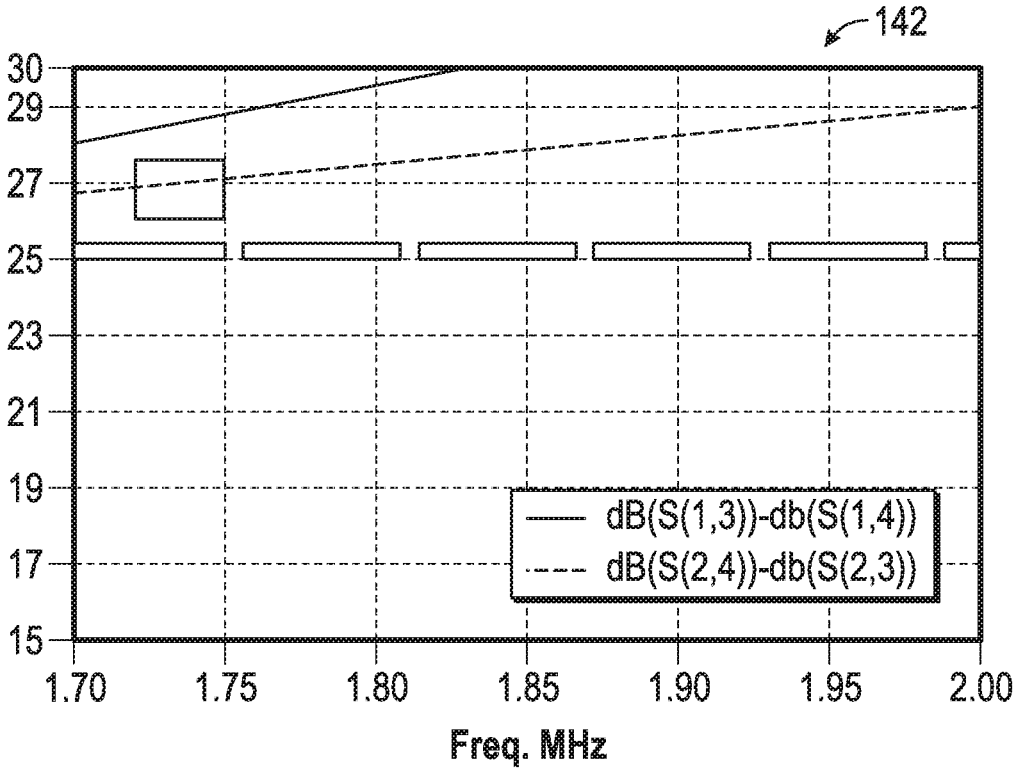
FIG. 14 is another graph representing behavior of an embedded directional coupler.

FIGS. 13-14 show graphs that represents simulated characteristics of directional couplers. FIG. 13 shows a graph 140 that representatively illustrates simulated passband directivity in dB between frequencies of 650-950 MHz and FIG. 14 shows a graph 142 that representatively illustrates simulated passband directivity in dB between frequencies of 1.70 and 2.00 MHz, both for a directional coupler having a general configuration similar to that of directional coupler described above with staggered rectangular floating tuning elements (and with filters), except in this case the rectangular floating elements were widened and they were spaced further apart from their nearest neighboring floating elements horizontally. It may be seen from the simulation by comparing FIG. 12 to FIG. 14 that widening the rectangular floating elements and increasing the space between them increased directivity (as seen by the vertical shift).

Naturally, the shape, quantity, pitch, size, orientation, the use of floating elements or openings in an electrically conductive layer, etc., can all modify the directivity and/or the coupling coefficient of a directional coupler. In some cases, floating elements such as squares, rectangles, circles, or other shapes, could themselves have openings therein similar to the openings described previously in layers, and this could also be used to affect tuning (modifying of the coupling coefficient and/or directivity characteristics).

Embedded directional couplers disclosed herein may accordingly have vertical or, in other words, three dimensional (3D) stacking configurations and may be used for higher frequencies (such as above 200 MHz). The 3D stacking of elements used to form the directional couplers may result in a smaller footprint and a general overall size reduction for the overall system. Element and methods described herein may also enhance performance (by increasing directivity and/or coupling coefficient) and add design flexibility (the ability to achieve varying package shapes and sizes by using custom-tailored tuning elements).

A patterned electrically conductive layer, such as the electrically conductive layers 102 or 132, may in other implementations be configured so that they are grounded. In such cases they may take the place of a standard ground plate and may have openings patterned therein to affect tuning of the coupling coefficient and/or directivity characteristics. For example, referring to FIG. 16 the tuning elements 202 could be excluded and the electrically conductive ground layer 204 could be replaced by the electrically conductive layer 102 or 132, which layer is then grounded, so that the ground layer provides a ground and also provides tuning. The embedded directional coupler 144 could likewise be modified so that the tuning elements 166 are removed and so that one of its ground layers is replaced by an electrically conductive layer 102 or 132 but not grounded, or one of these layers which is grounded, or two matching layers 102 or 132 that are both grounded, or two non-matching layers 102 or 132 (or having any other configuration of openings) one of which is grounded and one of which is not. Other configurations are possible, and in other embedded directional couplers described above, which include electrically conductive layers having openings therein, these layers could be used to replace a ground plate of the directional coupler by grounding the layer and the openings therein could provide tuning.

In implementations a patterned ground layer may be used, having reticulated openings therein, and floating tuning elements may also be used. For example, in the examples shown in FIGS. 15-16 any of the ground layers could be replaced by a ground layer having a number of tuning elements therein which are formed by openings in the ground layer, and the tuning elements 166/202 could remain in place as well. In some cases, the floating tuning elements could be made to correspond or to be a "negative" of the openings in the reticulated ground layer (such as a ground layer with an array of circular openings therein and floating circular tuning elements organized into a corresponding array). Alignment and misalignment of floating tuning elements and corresponding openings in reticulated ground layers may be simulated and/or experimented with to achieve desired tuning characteristics.

In any implementation in which floating tuning elements are used, the floating tuning elements could be located only above the main and coupled lines, or above and below the coupled lines, or only below the coupled lines, or in some implementations even between the main and coupled lines, and/or any combination thereof.

In implementations the dielectric layers which surround the main and coupled lines (or couple thereto) may be formed using materials having an epsilon value unequal to 1, and patterned materials (metallic and/or ferro-electric) may be used for the main and coupled lines to affect both inductive coupling and capacitative coupling between traces. Capacitative coupling between traces may be varied by varying the separation distance. Inductive coupling between traces may be varied by varying the sizes and shapes (length, width, and shape) of the main line and coupled line traces. The directional couplers may work over a range of frequencies where the inductive and capacitative factors balance one another out. The use of tuning elements as described herein allows one to alter the range of frequencies in which some directional couplers may be used by altering directivity and coupling coefficient as desired.

Although this disclosure discusses many RF measurement directional couplers, the directional couplers disclosed herein may be configured to be used with other wavelengths. Directional couplers disclosed herein could be used in many industries and for many applications, such as closed-loop tuning in wirelessly communicative or wirelessly-powered medical devices, tuning in other wirelessly-powered devices, and so forth.

In implementations the phrase "regular pattern" as used herein may refer to a plurality of tuning elements that are all coplanar and/or that are spaced at equal distances from nearest neighboring tuning elements and/or arranged into one or more rows and/or columns within the single plane.

In implementations where floating tuning elements are used the tuning elements do not all have to have the same size and/or shape. For instance, in implementations some of the floating tuning elements could be circles while others could be rectangles or squares, such as in an alternating pattern or in some other regular or irregular pattern. To some extent the tuning elements disclosed herein may be considered parasitic tuning elements.

The dielectric layers disclosed herein in implementations may be formed of FR4 (or another PCB material), sapphire, ceramic, plastic (polymer), barium-strontium-titanate (BST) and derivative compounds, or some other high-K electrically insulative material or any combination thereof. The electrically conductive elements may be formed of copper, gold, aluminum, or other metals or electrically conductive materials.

In implementations tuning elements that are openings in an electrically conductive layer could be configured to be resonant to provide a filtered load. In such an implementation the directional coupler could be used as a resonant load for a slot antenna.

In places where the description above refers to particular implementations of embedded directional couplers and related methods and implementing components, sub-components, methods and sub-methods, it should be readily apparent that a number of modifications may be made without departing from the spirit thereof and that these implementations, implementing components, sub-components, methods and sub-methods may be applied to other embedded directional couplers and related methods.

What is claimed is:

1. An embedded directional coupler, comprising:

a main line formed of an electrically conductive material and comprising an input port and an output port, the main line coupled at least partially one of in or on a dielectric layer;

a coupled line formed of an electrically conductive material and separated from the main line by a separation distance, the coupled line comprising a coupled port, the coupled line at least partially formed one of in or on the dielectric layer;

an electrically conductive ground layer coupled with the dielectric layer and electrically isolated from the main line and the coupled line with the dielectric layer; and an electrically conductive plate with only four sides comprising a plurality of rectangular openings arranged in a pattern, wherein the rectangular openings overlap both the main line and the coupled line;

wherein the electrically conductive plate is encapsulated in a dielectric layer and the plurality of rectangular openings are electrically conductive tuning elements electrically isolated from the main line, the coupled line, and the electrically conductive ground layer through the dielectric layer, the plurality of rectangular openings increasing one of a coupling coefficient or a directivity of the directional coupler;

wherein the main line and the coupled line are in the same horizontal plane;

wherein the coupled line comprises a filter on the coupled port.

2. The directional coupler of claim 1, wherein the pattern comprising the plurality of rectangular openings repeats at uniform intervals.

3. The directional coupler of claim 1, wherein the separation distance varies along a longest length of the main line.

4. The directional coupler of claim 1, wherein the variation of the separation distance creates harmonic interference for an electromagnetic wave carried across the main line.

5. The direction coupler of claim 1, wherein the directional coupler is in a stripline configuration.

6. The directional coupler of claim 1, further comprising a second electrically conductive ground layer coupled with the dielectric layer and electrically isolated from the main line, the coupled line, and the electrically conductive ground layer with the dielectric layer.

7. An embedded directional coupler, comprising:

a main line formed of an electrically conductive material and comprising an input port and an output port, the main line coupled at least partially one of in or on a dielectric layer;

a coupled line formed of an electrically conductive material and separated from the main line by a separation distance, the coupled line comprising a coupled port, the coupled line at least partially formed one of in or on the dielectric layer;

an electrically conductive ground layer coupled with the dielectric layer and electrically isolated from the main line and the coupled line through the dielectric layer; and an array of a plurality of electrically conductive tuning elements, wherein none of each of the plurality of electrically conductive tuning elements of the array span the entire separation distance between the main line and the coupling line and wherein the entire array spans across and is within a perimeter of the main line and the coupling line;

wherein the array of the plurality of electrically conductive tuning elements is encapsulated in a dielectric layer and the plurality of electrically conductive tuning elements is electrically isolated from the main line, the coupled line, and the electrically conductive ground layer through the dielectric layer;

wherein the plurality of electrically conductive tuning elements increases one of a coupling coefficient or directivity of the directional coupler; and wherein each of the plurality of electrically conductive tuning elements comprises a circular shape.

8. The directional coupler of claim 7, wherein a pattern of the array is one of a regular pattern and a complex regular pattern.

9. The directional coupler of claim 7, wherein the pattern is an irregular pattern.

10. The directional coupler of claim 7, further comprising a second electrically conductive ground layer coupled with the dielectric layer and electrically isolated from the main line, the coupled line, and the electrically conductive ground layer with the dielectric layer.

* * * * *